US006484376B1

(12) United States Patent
Khatchadourian et al.

(10) Patent No.: US 6,484,376 B1
(45) Date of Patent: Nov. 26, 2002

(54) JEWELRY SAFETY CLASP

(75) Inventors: Puzant Khatchadourian, 100 United Nations Plaza, 327 E. 48th Street, Apt. 38A, New York, NY (US) 10017; Edward Czajka, Brooklyn, NY (US)

(73) Assignee: Puzant Khatchadourian, New York, NY (US)

( * ) Notice: Subject to any disclaimer, the term of this patent is extended or adjusted under 35 U.S.C. 154(b) by 0 days.

(21) Appl. No.: 09/682,152

(22) Filed: Jul. 27, 2001

(51) Int. Cl.[7] ..... A44B 11/26; A44B 21/00; A44C 5/00

(52) U.S. Cl. ..... 24/658; 24/68 J; 24/71 J; 24/116 A; 24/616

(58) Field of Search ..... 24/658, 688, 303, 24/616, 615, 116 A, 68 J, 71 J

(56) References Cited

U.S. PATENT DOCUMENTS

| | | | | | |
|---|---|---|---|---|---|
| 1,098,597 | A | * | 6/1914 | Taylor | 24/616 |
| 1,228,711 | A | * | 6/1917 | Steinberger | 24/658 |
| 1,504,761 | A | * | 8/1924 | Hubbell | 24/116 A |
| 2,629,156 | A | | 2/1953 | Kamens et al. | 24/211 |
| 2,714,269 | A | * | 8/1955 | Charles | 24/116 A |
| 3,611,513 | A | | 10/1971 | Hoober et al. | 24/211 |
| 3,765,064 | A | | 10/1973 | Hoober et al. | 24/211 |
| 4,001,923 | A | | 1/1977 | Frankel et al. | 24/230 |
| 4,170,809 | A | | 10/1979 | Geldwerth et al. | 24/230 |
| 4,246,679 | A | * | 1/1981 | Monett | 24/615 |
| 4,286,360 | A | | 9/1981 | Skobel | 24/230 |
| 5,845,373 | A | * | 12/1998 | Langer | 24/303 |
| 6,041,479 | A | * | 3/2000 | Colpo | 24/658 |
| 6,145,171 | A | | 11/2000 | Hoshino | 24/573.1 |
| 6,289,559 | B1 | * | 9/2001 | Langer | 24/68 J |

* cited by examiner

*Primary Examiner*—Victor Sakran
(74) *Attorney, Agent, or Firm*—Darby & Darby

(57) ABSTRACT

A jewelry safety clasp includes a female member and a male member. The female clasp member includes a hollow housing, and a locking member slidably connected to the housing. The locking member has a push button disposed at one end thereof that projects through an opening in the housing. The locking member slides between a first locked position and a second unlocked position. A spring biases the locking member into the locked position. The male clasp member includes a shaft having a first reduced diameter portion adjacent to its free end and a second reduced diameter portion spaced from the first reduced diameter portion. In the locked position, the shaft is received within the housing with the locking member disposed about the second reduced diameter portion, thereby preventing said shaft from moving axially with respect to the housing.

10 Claims, 2 Drawing Sheets

FIG. 3
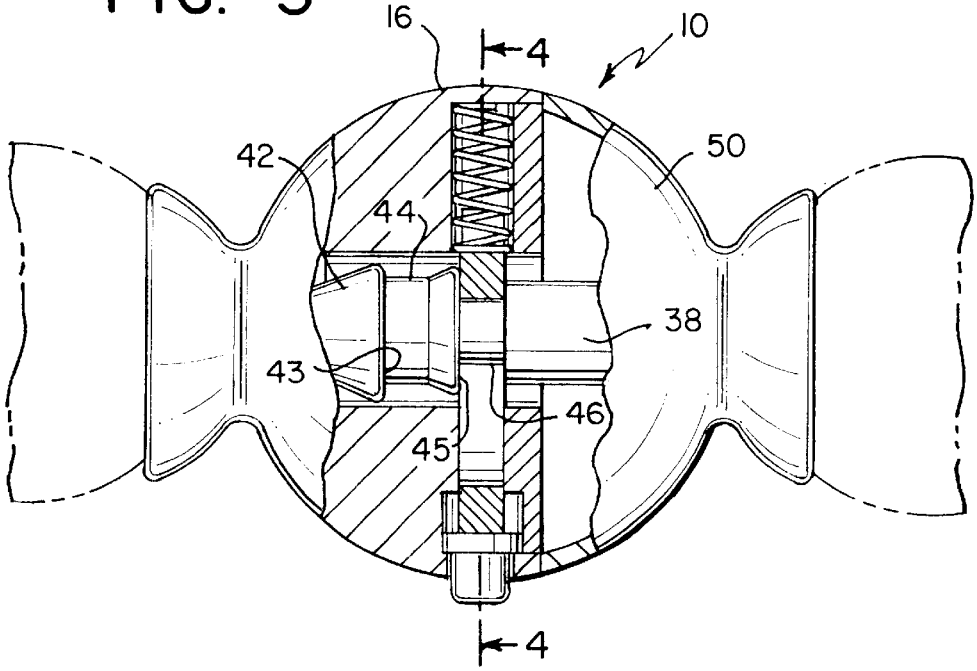
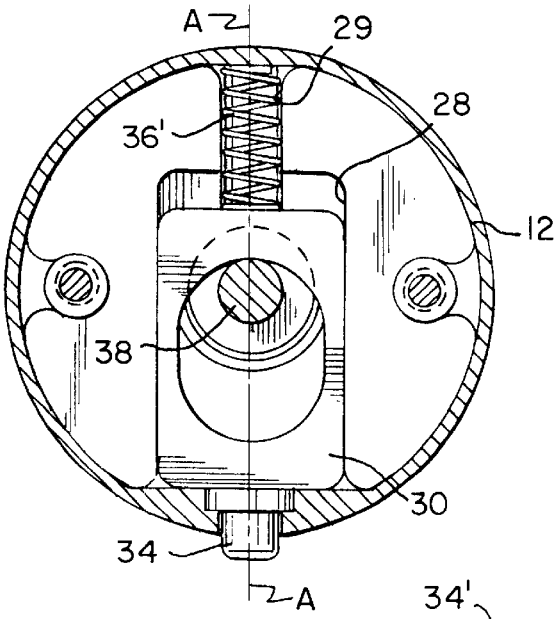
FIG. 4
FIG. 5
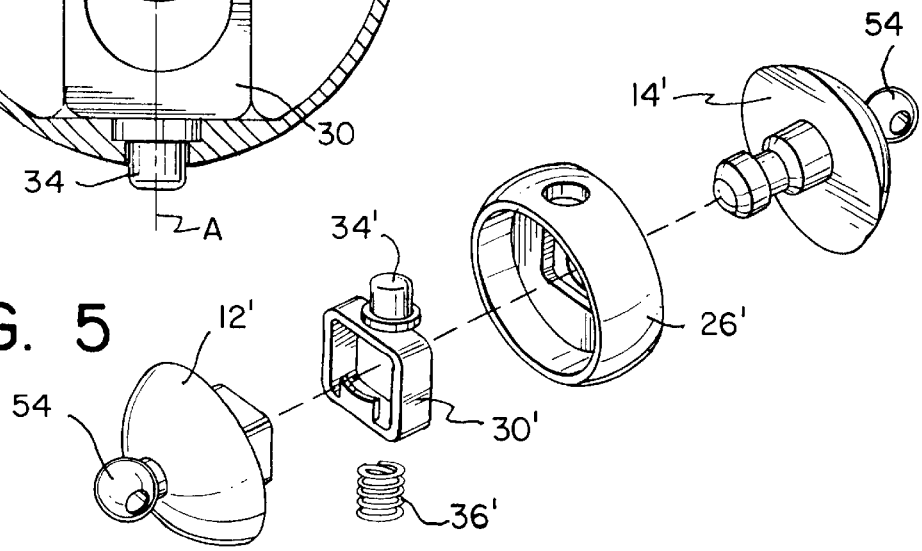

JEWELRY SAFETY CLASP

BACKGROUND OF INVENTION

The present invention relates to jewelry safety clasps for use with jewelry items such as necklaces, bracelets, etc. More specifically, the present invention relates to a jewelry safety clasp that has a primary locked position and a safety locked position to prevent the inadvertent opening of the clasp.

Jewelry safety clasps for selectively securing the ends of a chain together are known. One type of clasp is described in U.S. Pat. Nos. 4,001,923 and 4,286,360. In these patents there is described a clasp having a male and a female member which are adapted to be clasped together by releasable locking means engaging the male member to hold it within the female member. The locking means is disposed in the female member and includes an integral one piece member having a locking portion for engaging the male member, a resilient portion for biasing a locking portion against the male member, and an actuating portion for moving the locking portion relative to the pressure of the resilient portion for releasing the male member, to thereby permit retraction thereof from the female member. The female member also includes holding means to position the resilient portion relative to the female member.

In this clasp, should the actuating portion be inadvertently actuated, for example, by an undesired external force, the female member will retract from the male member, often without the person wearing the jewelry item being aware that the clasp has opened. Thus, the person runs the risk of losing the jewelry item.

Attempts have been made to provide a clasp with a safety catch. Among these attempts are the use of a separate chain that is fixedly attached to either the male or female member. The free end of the chain is attachable to the other member. Thus, should the clasp inadvertently open, the chain serves to keep the male and female members connected together. This type of safety chain requires the use of additional material, which can detract from the appearance of the clasp. In addition, the connection of the free end of the chain to the other member is usually an interference fit that deteriorates over time.

Thus, it is an object of the present invention to provide a jewelry safety clasp that prevents the inadvertent opening of the clasp.

SUMMARY OF INVENTION

The jewelry safety clasp in accordance with the present invention achieves the above and other objects in a currently preferred exemplary embodiment that includes a female member and a male member. The female clasp member includes a hollow housing, and a locking member slidably connected to the housing. The locking member has a push button disposed at one end thereof that projects through an opening in the housing. The locking member slides between a first locked position and a second unlocked position. A spring biases the locking member into the locked position. The male clasp member includes a shaft having a first reduced diameter portion adjacent to its free end and a second reduced diameter portion spaced from the first reduced diameter portion. In the locked position, the shaft is received within the housing with the locking member disposed about the second reduced diameter portion, thereby preventing said shaft from moving axially with respect to the housing.

BRIEF DESCRIPTION OF DRAWINGS

The above and still further objects, features and advantages of the present invention will become apparent upon consideration of the following detailed description of a specific embodiment thereof, especially when taken in conjunction with the accompanying drawings wherein like reference numerals in the various figures are utilized to designate like components, and wherein:

FIG. 3 is a cross-sectional view of the clasp in the locked position;

FIG. 4 is a cross-sectional view taken along line 4—4 of FIG. 3 and looking in the direction of the arrows; and FIG. 5 is an exploded perspective view of the jewelry safety clasp in accordance with another embodiment of the present invention.

DETAILED DESCRIPTION

Figure 1:
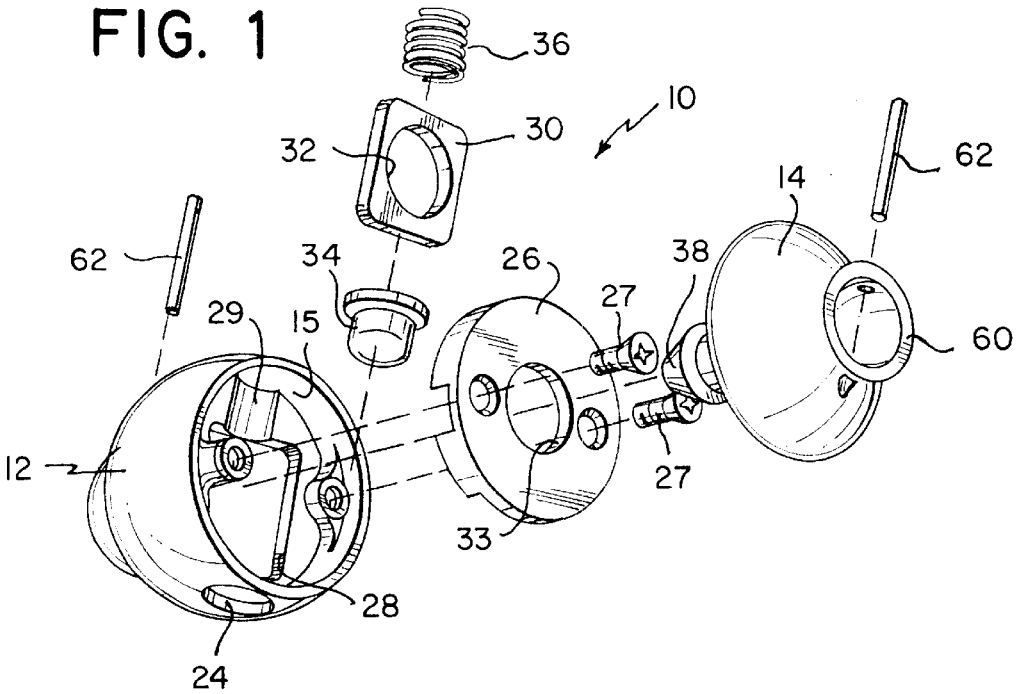
FIG. 1 is an exploded perspective view of the jewelry safety clasp in accordance with the present invention.

Referring now to FIGS. 1—4, a jewelry safety clasp 10 in accordance with the present invention is illustrated. The clasp includes a female clasp member 12 and a male clasp member 14. The female clasp member 12 includes a hollow housing 15 (See FIGS. 1 and 2). Hollow housing 15 has a generally annular-shaped outer wall 16, a first axial end 18 and a second axial end 20. A first opening 22 is disposed in the first axial end 18. First opening 22 is illustrated having an enlarged diameter portion 35 extending toward second axial end 20. If desired, first opening 22 may not include a step, but, in this construction, has a diameter large enough to receive a shaft 38 of male clasp member 14, to be described below. The generally annular-shaped wall 16 has a second opening 24 therein, as illustrated in FIG. 1. Openings 22, 24 are each preferably circular in cross-sectional shape, but can, of course, be of any desired shape.

A cap 26 is fixedly connected to outer wall 16 at its second axial end 20. As illustrated, cap 26 is preferably connected to housing 15 by a pair of threaded fasteners 27. Of course, however, one skilled in the art will readily recognize that any manner may be used, such as, for example, welding, to secure housing 15 to cap 26. If desired, cap 26 and housing 15 can be formed as a one-piece unitary member. A locking member 30 is slidably connected within housing 15. Locking member 30 has a central opening 32. As illustrated in FIGS. 1 and 4, second axial end 20 includes a rectangular shaped recessed bearing surface 28 and a relatively narrow semi-cylindrical-shaped recess 29 that opens into recessed bearing surface 28. The rectangular recess 28 acts as an axial bearing surface for sliding member 30 to prevent the axial movement of sliding member 30 once cap 26 is connected to housing 15. Rectangular recess 28 also acts as a radial guide for sliding member 30 along radial line A—A as shown in FIG. 4. Sliding member 30 preferably slides only linearly in a radially direction along the axis of push button 34, which will be described in greater detail below. Cap 26 has a central opening 33 of sufficient diameter to receive shaft 38.

A push button 34 is disposed at one end of locking member 30. A portion of push button 34 projects outwardly from second opening 24 in the assembled position. Locking member 30 slides between a first locked position (as shown in FIG. 3) and a second unlocked position. A coil spring 36 is mounted within hollow housing 15 between locking member 30 and an inside surface of annularly-shaped outer wall 16. Coil spring 36 normally biases locking member 30 into the locked position where push button 34 projects outwardly through second opening 24, as shown in FIG. 3.

Locking member 30 is moveable to the unlocked position upon the application of an external force against push button 34 that is sufficient to overcome the bias applied by spring 36, thereby pressing push button 34 partially into housing 15 via second opening 24.

Figure 2:
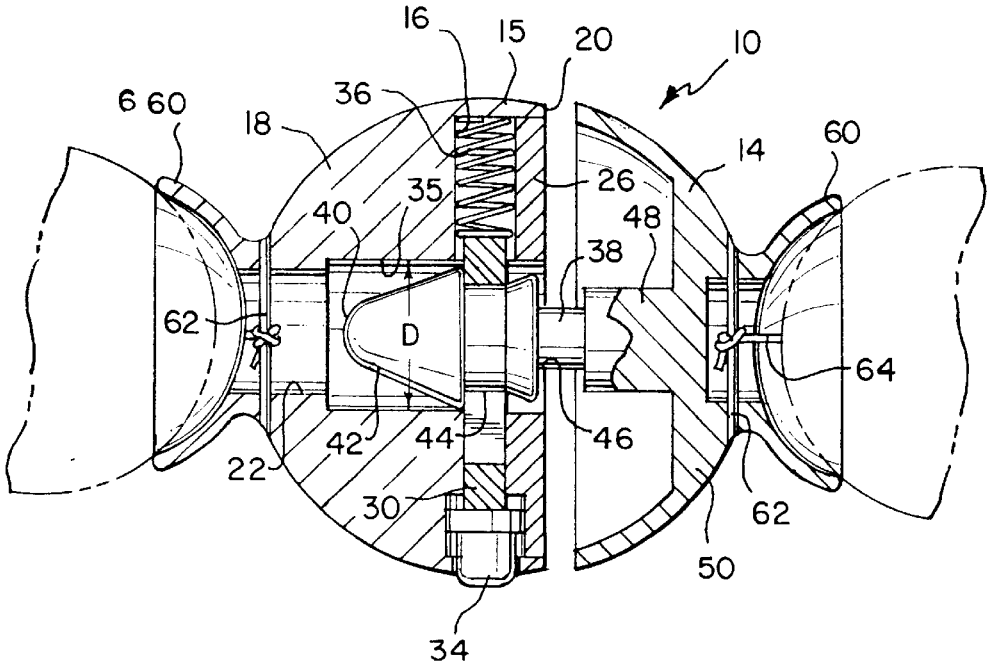
FIG. 2 is a cross-sectional view of the clasp in a safety lock position.

Male clasp member 14 includes a shaft 38 that has a nominal outer diameter D that is smaller than the diameter of the enlarged diameter portion 35 of first opening 22 and the diameter of opening 32 in sliding locking member 30 and opening 33 in cap 26. Thus, shaft 38 is receivable within both the opening 33 of cap 26 and opening 32 within sliding locking member 30. Shaft 38 has a first end 40 that is at least partially conically-shaped 42 to facilitate the entry of shaft 38 into the central opening 23 in cap 26 and into throughbore 32 in locking member 30. Shaft 38 also has a first reduced diameter portion 44 and a second reduced diameter portion 46. First reduced diameter portion 44 is disposed adjacent to the distal end 40 and the second reduced diameter portion 46 is spaced from the second reduced diameter 44, as illustrated in FIGS. 2 and 3.

Additionally, the second end 48 of shaft 38 is integrally connected as a one piece assembly to a cap-shaped member or head 50. Male clasp member 14 has an annular cup-shaped flange 60 connected to cup-shaped head 50 on an exterior surface thereof, which is opposite to shaft 38. A pin 62 is fixedly connected to male clasp member 14, preferably by welding or brazing, at a position interior of flange 60 within the recess formed by flange 60. Female clasp member 12 includes an identical flange 60 and pin 62. Thus, a bead, pearl, or other jewelry item may be pulled tight against flange 60 and tied in place by tying its string 64 tightly about pin 62. Thus, the bead or pearl or other jewelry item is not spaced from the safety clasp. Alternatively, as illustrated in FIG. 5, an eyelet 54 is integrally connected on the exterior of male clasp member 14 and female clasp member 12. Thus, cap 26 and cup-shaped member 50 can each be easily connected to, for example, a chain or other jewelry item, in a conventional matter as known to those skilled in the art.

In the locked position, shaft 38 is received within housing 15 with a portion of the shaft being received in opening 33 in cap 26. Locking member 30 is disposed about second reduced diameter 46, thereby preventing shaft 38 and, thus, male clasp member 14 from moving axially with respect to female clasp member 12. As illustrated in FIG. 3, shaft 38 has a conical transition from first reduced diameter portion 44 to the outer diameter of shaft 38 in a direction towards the second reduced diameter portion 46 to facilitate entry of shaft 38 into the female member, including its locking member 30. As also illustrated in FIG. 3, shaft 38 has a stepped transition 45 in the opposite direction from second reduced diameter portion 46 to the outer diameter of shaft 38 and another stepped transition 43 from the first reduced diameter portion 44 to the outer diameter of shaft 38.

In the locked position, cup-shaped head 50 of male member 14 preferably meshes flush with outer wall 16 to provide a smooth external surface for jewelry safety clasp 10. Similarly, the external surface of cap 26 preferably meshes flush with outer wall 16 to also provide a smooth outer surface for clasp 10. However, it will be readily apparent to those skilled in the art that the external shape of the clasp member can be of any desired shape, including spherical, ellipsoid, cylindrical, etc., depending upon the needs of the jewelry manufacturer and/or the desires of the end user of the jewelry safety clasp.

To close jewelry safety clasp 10, shaft 38 of male clasp member 14 is first inserted into opening 33 in cap 26. Shaft 38 is further inserted into the female member 12 until first end 40, including its conical surface 42, abuts sliding locking member 30. Sliding locking member 30 is normally in a locked position due to the bias of spring 36. However, insertion of shaft 38, causes the conical surface 42 to abut against locking member 30. More specifically, conical surface 42 slides against the inner surface of opening 33 causing locking member 30 to slide to its unlocked position, thereby permitting shaft 38 to continue to move past locking member 30. Shaft 38 is continued to be inserted into female member 12 until stepped shoulder 43 moves past locking member 30, thereby causing locking member 30 to snap into its locked position. This position of shaft 38 with respect to the female member 12 is referred to as the safety lock position (see FIG. 2). To fully close the clasp 10, male member 14 is further inserted, causing conical surface 47 to abut against locking member 30, thus causing locking member 30 to slide to its unlocked position once again. Continued movement of shaft 38 into female member 12 causes stepped shoulder 45 to move past locking member 30, thereby causing locking member 30 to snap into its locked position once again. This is the final locked position and the clasp is now closed, (see FIG. 3).

To open jewelry safety clasp 10, push button 34 must be inserted partially into housing 15, thereby causing locking member 30 to move from its locked position to its unlocked position. While push button 34 is depressed, male member 14 is grasped and removed from female member 12.

Should an undesired external force be applied against push button 34, shaft 38 of male member 14 may begin to withdraw from female member 12. However, these external forces are rarely applied for an extended period of time. Thus, locking member 30 will, in most instances, slide into first reduced diameter portion 44 and stepped shoulder 43 will prevent shaft 38 from fully withdrawing from female member 12. Thus, the clasp will be maintained in its safety lock position as shown in FIG. 2.

Thus, while there have been shown, described, and pointed out fundamental novel features of the invention as applied to a preferred embodiment thereof, it will be understood that various omissions, substitutions, and changes in the form and details of the devices illustrated, and in their operation, may be made by those skilled in the art without departing from the spirit and scope of the invention. For example, it is expressly intended that all combinations of those elements and/or steps which perform substantially the same function, in substantially the same way, to achieve the same results are within the scope of the invention. Substitutions of elements from one described embodiment to another are also fully intended and contemplated. It is also to be understood that the drawings are not necessarily drawn to scale, but that they are merely conceptual in nature. It is the intention, therefore, to be limited only as indicated by the scope of the claims appended hereto. All patents, patent applications, procedures, and publications cited throughout this application are hereby incorporated by reference in their entireties.

What is claimed is:

1. A jewelry safety clasp comprising:

a female clasp member comprising:

a hollow housing, said housing having a generally annular-shaped wall, a first axial end and a second axial end, a first opening in said first axial end, said generally annular-shaped wall having a second opening of a predetermined dimension said second axial end having a recess;

a cap fixedly connected to said second axial end of said housing;

a locking member slidably received in said recess, said locking member having a throughbore of a predetermined dimension, said locking member having a push button disposed at one end thereof, said push button projecting through said second opening, said locking member sliding between a first locked position and a second unlocked position; and a spring mounted in said housing between said locking member and an inside surface of said generally annular-shaped wall, said spring biasing said locking member into said locked position, wherein said locking member is movable to said unlocked position upon the application of an external force against said push button; and a male clasp member comprising:

a shaft having an outer diameter that is smaller than said throughbore, said shaft having a first end that is at least partially conical in shape to facilitate entry of the shaft into said throughbore in said locking member, said shaft having a first reduced diameter portion adjacent to said first end and a second reduced diameter portion spaced from said first reduced diameter portion, wherein, in said locked position, said shaft being received within said housing with a portion of said shaft being received in said first opening in said first axial end wall, said distal end being disposed within said housing adjacent to said cap, and, said locking member being disposed about said second reduced diameter portion thereby preventing said shaft from moving axially with respect to said housing.

2. The jewelry safety clasp in accordance with claim 1, wherein said cap has an eyelet disposed on an outer surface thereof.

3. The jewelry safety clasp in accordance with claim 1, wherein said spring is a coil spring.

4. The jewelry safety clasp in accordance with claim 1, wherein each of said female clasp member and said male clasp member has an annular flange on an outer surface thereof.

5. The jewelry safety clasp in accordance with claim 4, wherein, in said locked position, said lip is received in said second reduced diameter portion of said shaft.

6. The jewelry safety clasp in accordance with claim 1, wherein said shaft has a conical transition from said first reduced diameter portion to said outer diameter in a direction toward said second reduced diameter portion.

7. The jewelry safety clasp according to claim 1, wherein said male clasp member having an eyelet connected to a second end of said shaft.

8. A jewelry safety clasp comprising:

a female clasp member comprising:

a hollow housing, said housing having an opening;

a locking member slidably connected to said housing within an interior thereof, said locking member having a push button disposed at one end thereof, said push button projecting through said opening, said locking member sliding between a first locked position and a second unlocked position; and a male clasp member comprising:

a shaft having a first end, a second end and an outer diameter, said shaft having a first reduced diameter portion adjacent to said first end and a second reduced diameter portion spaced from said first reduced diameter portion, wherein, in said locked position, said shaft being received within said housing with said locking member being disposed about said second reduced diameter portion thereby preventing said shaft from moving axially with respect to said housing.

9. A jewelry safety clasp comprising:

a female clasp member comprising:

a housing having an annular cup-shaped flange on an exterior surface thereof defining a cup-shaped recess;

a pin fixedly connected to said housing within said cup-shaped recess;

means for mounting a jewelry item in direct contact with said cup-shaped flange of said female clasp member;

a male clasp member comprising;

a housing having an annular cup-shaped flange on an exterior surface thereof defining a cup-shaped recess;

a pin fixedly connected to said housing within said cup-shaped recess;

means for mounting a jewelry item in direct contact with said cup-shaped flange of said male clasp member.

10. A jewelry item comprising:

a string having a plurality of jewelry items connected thereto, said string having a first end and a second end;

a clasp comprising:

a female clasp member comprising:

a housing having a first annular cup-shaped flange on an exterior surface thereof defining a cup-shaped recess;

a first pin fixedly connected to said housing within said first cup-shaped recess;

a male clasp member comprising:

a housing having a second annular cup-shaped flange on an exterior surface thereof defining a cup-shaped recess;

a second pin fixedly connected to said housing within said second cup-shaped recess; and wherein, said first end of said string is connected to said first pin so that one of said jewelry items contacts said first flange, said second end of said string is connected to said second pin so that a second one of said jewelry items contacts said second flange.

* * * * *